US009639109B2

(12) United States Patent
Weigl

(10) Patent No.: US 9,639,109 B2
(45) Date of Patent: May 2, 2017

(54) INPUT UNIT FOR AN OPERATING ELEMENT THAT CAN BE ACTUATED BY PRESSURE OR ROTATION

(71) Applicant: Leopold Kostal GmbH & Co. KG, Luedenscheid (DE)

(72) Inventor: Ilja Weigl, Dortmund (DE)

(73) Assignee: Leopold Kostal GmbH & Co. KG, Ludenscheid (DE)

( * ) Notice: Subject to any disclaimer, the term of this patent is extended or adjusted under 35 U.S.C. 154(b) by 77 days.

(21) Appl. No.: 14/813,763

(22) Filed: Jul. 30, 2015

(65) Prior Publication Data

US 2015/0338874 A1 Nov. 26, 2015

Related U.S. Application Data

(63) Continuation of application No. PCT/EP2014/054468, filed on Mar. 7, 2014.

(30) Foreign Application Priority Data

Mar. 12, 2013 (DE) ..... 10 2013 004 381

(51) Int. Cl.
*G05G 1/02* (2006.01)
*G05G 9/02* (2006.01)
(Continued)

(52) U.S. Cl.
CPC ..... *G05G 1/02* (2013.01); *G05G 1/08* (2013.01); *G05G 5/08* (2013.01); *G05G 9/02* (2013.01); *Y10T 74/20201* (2015.01)

(58) Field of Classification Search
CPC G05G 1/02; G05G 5/08; H01H 19/00; H01H 27/00
(Continued)

(56) References Cited

U.S. PATENT DOCUMENTS 6,388,212 B1 5/2002 Ishihara et al.
7,381,912 B2 6/2008 Hyun et al.
(Continued)

FOREIGN PATENT DOCUMENTS

CN 1289136 A 3/2001
CN 1534424 A 10/2004
(Continued)

OTHER PUBLICATIONS

European Patent Office, International Search Report for International Application No. PCT/EP2014/054468 mailed Jun. 16, 2014.
(Continued)

*Primary Examiner* — Edwin A. Leon
*Assistant Examiner* — Iman Malakooti
(74) *Attorney, Agent, or Firm* — Brooks Kushman P.C.

(57) ABSTRACT

An input unit for an operating element that can be actuated by pressure or rotation includes a housing having a recess portion, a carrier having a detent projection, and an input member (e.g., an actuator). The carrier is displacable relative to the housing. The input member is rotatably mounted on the carrier to be rotatable. The input member has a body with a cavity therein and a detent curve body movably arranged in the cavity such that the detent curve body is displaceable relative to the body of the input member. A first end of the detent curve body has a detent curve engaging the detent projection of the carrier. A second end of the detent curve body is adjacent to the housing part and has projections. The input member further has a spring that acts on the detent curve body to press the detent curve against the detent projection.

10 Claims, 2 Drawing Sheets

(51) Int. Cl.
*G05G 1/08* (2006.01)
*G05G 5/08* (2006.01)

(58) Field of Classification Search
USPC ..... 200/4, 43.07, 61.54, 336
See application file for complete search history.

(56) References Cited

U.S. PATENT DOCUMENTS

| | | | | |
|---|---|---|---|---|
| 7,436,398 | B2 | 10/2008 | Yuasa et al. | |
| 2004/0189595 | A1 | 9/2004 | Yuasa et al. | |
| 2007/0051597 | A1* | 3/2007 | Hyun ..... | H01H 25/006 200/43.07 |
| 2014/0034461 | A1 | 2/2014 | Bloeink et al. | |

FOREIGN PATENT DOCUMENTS

| | | | |
|---|---|---|---|
| DE | 102007038580 | A1 | 2/2009 |
| DE | 102008012921 | A1 | 9/2009 |
| DE | 102011103633 | A1 | 12/2012 |
| DE | 102011103670 | A1 | 12/2012 |
| EP | 1759921 | A2 | 3/2007 |

OTHER PUBLICATIONS

The International Bureau of WIPO, International Preliminary Report on Patentability for International Application No. PCT/EP2014/054468 issued Oct. 7, 2015.

The State Intellectual Property Office of People's Republic of China, Chinese First Search for the corresponding Chinese Patent Application No. 201480009340.9 dated Feb. 15, 2016.

The State Intellectual Property Office of People's Republic of China, Chinese First Office Action for the corresponding Chinese Patent Application No. 201480009340.9 dated Mar. 2, 2016 English translation.

The State Intellectual Property Office of People's Republic of China, Chinese Notification to Grant Patent for the corresponding Chinese Patent Application No. 201480009340.9 Aug. 5, 2016 English translation.

* cited by examiner

INPUT UNIT FOR AN OPERATING ELEMENT THAT CAN BE ACTUATED BY PRESSURE OR ROTATION

CROSS-REFERENCE TO RELATED APPLICATIONS

This application is a continuation of International Application No. PCT/EP2014/054468, published in German, with an International Filing Date of Mar. 7, 2014, which claims priority to DE 10 2013 004 381.6, filed Mar. 12, 2013, the disclosures of which are hereby incorporated in their entirety by reference herein.

TECHNICAL FIELD

The present invention relates to an operating element that can be actuated by pressure and rotation, the operating element including an input unit having an input member rotatably mounted on a carrier to be rotatable about a rotation axis, the carrier being displaceable relative to a housing part in a direction normal to the rotation axis whereby the input member is displaceable in the direction normal to the rotation axis.

BACKGROUND

Many operating elements, particularly those used in motor vehicles, are provided with multiple functions. An example is a steering wheel control element having a rotating knurled handle that can be rotated endlessly and having pressure actuated switching functions. In order to prevent accidental operation, it is desired that various types of operations not be able to be executed concurrently.

An operating element that can be actuated by pressure and rotation as set forth in the above Technical Field is known from German patent application DE 10 2011 103 670 A1 (corresponds to U.S. Publication No. 2014/0034461). The operating element includes a cylindrically shaped input member (i.e., an actuator). The input member is connected to a rotatable shaft mounted on a carrier. The carrier is displaceable in a direction normal to the rotation axis of the shaft. A rotational sensor for detecting rotational movement of the input member is connected to the shaft. For example, the rotational sensor detects rotational movement of the input member through a code disk and a forked photoelectric sensor. The carrier is mounted on switching elements. The carrier displaces in the direction normal to the rotation axis when pressure is exerted on the input member. The displacement of the carrier causes the switching elements to activate. The switching elements produce electrical signals in response to being activated. The switching elements can be designed as micro-switches or as switch domes of a dome pressure sensitive mat.

The operating element further includes a detent wheel and a rotational spring-loaded lever. The detent wheel is next to the input member and is connected to the shaft. The detent wheel has along its perimeter an integrally molded detent curve. The lever includes a detent pin. The detent pin engages the detent curve of the detent wheel.

A rotational actuation of the input member follows in multiple sequential detent steps against the force exerted by the spring which acts on the lever. In a pressure actuation of the input member, the lever moves against a stop and prevents concurrent execution of a rotational actuation of the input member by blocking the detent wheel. For a rotational actuation of the input member, the bumps of the detent curve on the detent wheel deflect the lever, through which concurrent rotational motion is suppressed.

The detent wheel and the associated rotational spring-loaded lever require a relatively large amount of space.

SUMMARY

An object is a particularly simple and compactly formed input unit having locking functions that during the implementation of a pressure actuation or a rotational actuation of an input member of the input unit the concurrent implementation of the respective other type of actuation of the input member is blocked.

In carrying out at least one of the above and/or other objects, an input unit for an operating element that can be actuated by pressure or rotation is provided. The input unit includes a housing wall having a recess portion, a carrier having a detent projection, and an input member (e.g., an actuator). The carrier is displacable relative to the housing wall along a displacement axis. The input member is mounted on a shaft rotatably mounted on the carrier to be rotatable about a rotation axis normal to the displacement axis. The input member has a body with a cavity therein and a detent curve body movably arranged in the cavity such that the detent curve body is displaceable along an axial direction parallel with the rotation axis relative to the body of the input member. A first end of the detent curve body has a detent curve engaging the detent projection of the carrier. A second end of the detent curve body is adjacent to the housing wall and has projections. The input member further has a spring that acts on the detent curve body to press the detent curve against the detent projection.

At least one of the projections inserts into the recess portion of the housing wall when the detent curve body is displaced in the axial direction towards the recess portion of the housing wall during rotational motion of the input member.

At least one of the projections engages the housing wall when the input member is displaced along the displacement axis during pressure actuation of the input member.

The detent curve includes alternate detent elements. A height of the detent elements of the detent curve along the axial direction is greater than a distance between the projections and the recess portion of the housing wall along the axial direction while the input member is in an unactuated state.

Further, in carrying out at least one of the above and other objects, another input unit is provided. The input member of the input unit rotates when the input member is rotationally actuated and displaces with the carrier relative to the housing wall when the input member is pressure actuated. At least one of the projections on the second end of the detent curve body engages the housing wall when the input member, during pressure actuation of the input member, is displaced with the carrier relative to the housing wall which thereby prevents displacement of the detent curve body relative to the body of the input member thereby blocking concurrent rotational actuation of the input member. At least one of the projections on the second end of the detent curve body inserts into the recess portion of the housing wall when the detent curve body, during rotational actuation of the input member, is displaced towards the recess portion of the housing wall to thereby block concurrent pressure actuation of the input member.

In an embodiment, an input unit for an operating element that can be actuated by pressure or rotation includes an input member (i.e., an actuator). The input member is rotatably mounted on a carrier to be rotatable about a rotation axis. The carrier is arranged pivotably against a housing part to be displaceable relative to the housing part along a displacement axis normal to the rotation axis whereby the input member is displaceable in a direction normal to the rotation axis.

The input member has a body with a hollow cavity therein. A detent curve body is movably or slidably arranged in the cavity of the input member such that the detent curve body is displaceable along an axial direction. The axial direction is parallel with the rotation axis. The detent curve body is displaceable along the axial direction relative to the body of the input member. A first end face of the detent curve body has a detent curve. A second end face of the detent curve body opposite to the first end face of the detent curve body has one or more projections. A spring arranged in the cavity acts on the detent curve body to bias (e.g., press) the detent curve body in the axial direction toward the first end face of the detent curve body. As such, the detent curve on the first end face of the detent curve body is pressed in the axial direction away from the second end face of the detent curve body.

A portion of the carrier adjacent the first end face of the detent curve body has a detent projection. The detent curve of the first end of the detent curve body engages with the detent projection. The detent curve presses against the detent projection as the detent curve is biased by the spring in the axial direction away from the second end face of the detent curve body and toward the detent projection.

A portion of the housing part adjacent the second end face of the detent curve body includes a wall section having a recess. The projections of the second end face of the detent curve body can insert into the recess of the housing part. One or more of the projections insert into the recess when the detent curve body is axially displaced in a direction towards the second end face of the detent curve body during rotational motion of the input member.

In accordance with embodiments of the present invention, an input member of an input unit of an operating element that can be actuated by pressure and rotation includes a detent curve body within a hollow cavity of a body of the input member. The detent curve body is movably arranged such that it can slide to be displaceable relative to the body of the input member in an axial direction along the rotation axis. A first end face of the detent curve body has a detent curve. A spring acts in the axial direction on the detent curve body. The spring presses the detent curve against a detent projection on a portion of a carrier adjacent to the first end face of the detent curve body. An opposite second end face of the detent curve body has one or more molded projections. The projections displace in the axial direction with displacement of the detent curve body relative to the body of the input member in the axial direction. The projections can displace in the axial direction into a recess of a wall section of a housing part adjacent to the second end face of the detent curve body.

The detent curve attached to or integrally molded with the detent curve body and the movable arrangement of the detent curve body in the hollow cavity of the body of the input member enable a compact layout of the input member, particularly since no space needs to be provided for a detent wheel next to the input member.

BRIEF DESCRIPTION OF THE DRAWINGS

In the following, the structure and manner of operation of an input unit according to embodiments of the present invention are described in greater detail with the aid of an exemplary embodiment shown in the drawings.

DETAILED DESCRIPTION

Figure 2:
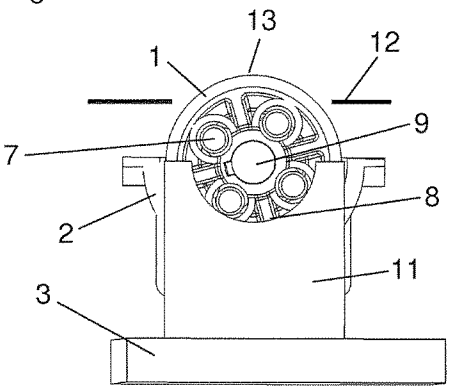
FIG. 2 illustrates an end view of the input unit in the neutral actuation stage.

Detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Referring now to FIGS. 1, 2, 3, 4, 5, and 6, an input unit of an operating element that can be actuated by pressure and rotation is shown. The input unit is a component of the pressure and rotationally actuated operating element. The input unit can, for example, be used on the steering wheel of a motor vehicle. Thus, only the input unit of the control element is shown.

The input unit includes an input member (i.e., an actuator) 1, a carrier 2, and a housing part 3. Input member 1 is cylindrically-shaped. Input member 1 is rotatably mounted on carrier 2 to be rotatable about a rotation axis. Carrier 2 is pivotably arranged against housing part 3 to be displaceable relative to the housing part along a displacement axis normal to the rotation axis. As input member 1 is mounted to carrier 2, the input member is displaceable along the displacement axis normal to the rotation axis with the carrier.

Electronic and electromechanical components of the operating element are not shown. Description of such components, for example, rotational sensors, switches or dome pressure sensitive mats, is incidental to the illustration of the input unit. Possible embodiments of such components are known, for example, from the description of the above mentioned DE 10 2011 103 670 A1.

Input member 1 is a rotationally symmetric cylindrical input member. Input member 1 is mounted rotationally to a shaft 9. Shaft 9 is mounted on carrier 2 to be rotatable about the rotation axis. Thus, input member 1 is rotatable about the rotation axis. An electrical rotational sensor (not shown) is connected to shaft 9 and to carrier 2. The rotational sensor can be accomplished by a forked photoelectric sensor or an electrical pulse transmitter. The rotational sensor detects rotational actuations of input member 1 associated with shaft 9 and converts the rotational actuations into electrical signals that can be evaluated.

At the point of attachment of the operating element a partial section of an outer surface 13 of the body of input member 1 is accessible through a recess in a fascia panel 12. The accessible outer surface section 13 of input member 1 can be manipulated in order to rotate the input member about the rotation axis.

Along with the rotational actuation, one or more types of pressure actuation of the operating element are provided. The pressure actuation takes place by forces applied perpendicular to the accessible outer surface section 13 of input member 1. Such forces applied perpendicular to the accessible outer surface section 13 of input member 1 are perpendicular to the rotation axis and thereby align with the displacement axis normal to the rotation axis. The pressure actuations cause a pivoting of carrier 2 relative to housing part 3 in the displacement axis normal to the rotation axis. The pivoting of carrier 2 about housing part 3 causes switching elements (not shown) located rigidly to the housing part to deflect. For example, the switching elements include the domes of a dome pressure sensitive mat. The domes are deflected as a result of the pivoting of carrier 2 relative to housing part 3. Electrical switch contacts corresponding to the domes are closed or opened through the deflection of the domes.

Figure 1:
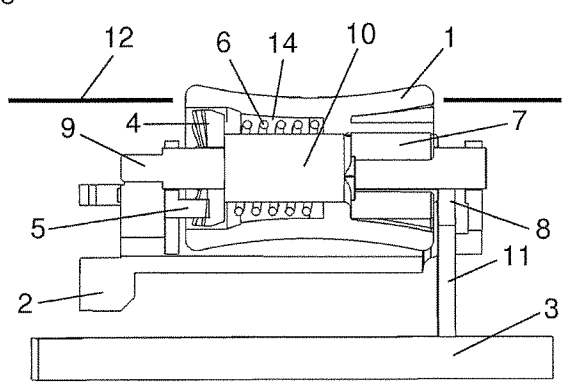
FIG. 1 illustrates a sectional view through an input unit in a neutral actuation stage.
Figure 3:
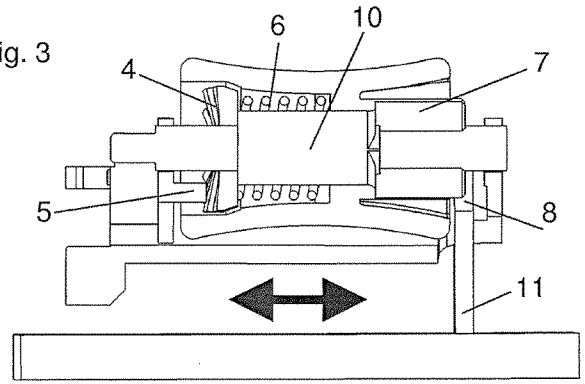
FIG. 3 illustrates a sectional view through the input unit in a rotational actuation stage.
Figure 5:
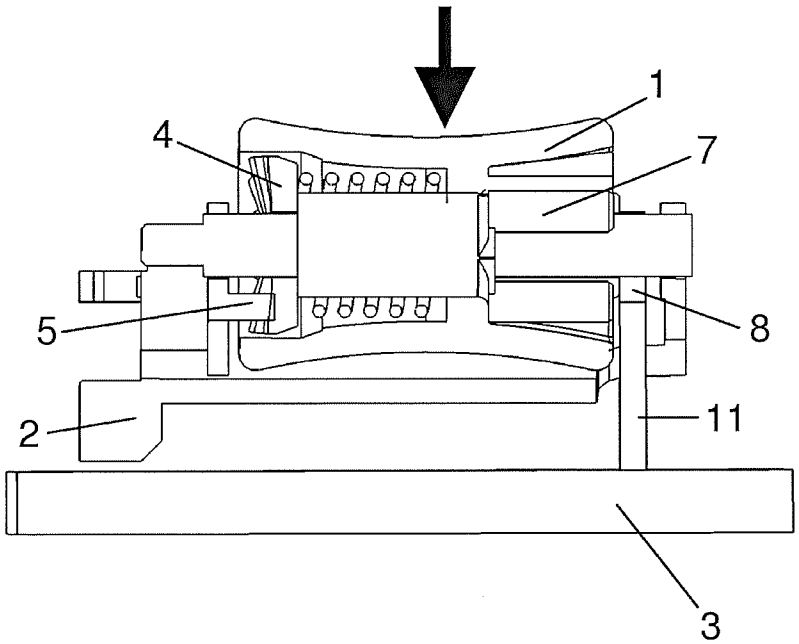
FIG. 5 illustrates a sectional view through the input unit in a pressure actuation stage; P

As shown in FIGS. 1, 3, and 5, the interior of the body of input member 1 forms a hollow cavity 14. A detent curve body 10 is located within cavity 14 of the body of the input member 1. Detent curve body 10 can be displaced in an axial direction by a sliding motion. As such, detent curve body 10 is displaceable in the axial direction relative to the body of input member 1. The axial direction is parallel with the rotation axis or aligned with the rotation axis.

Figure 4:
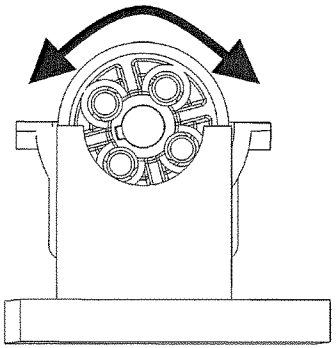
FIG. 4 illustrates an end view of the input unit in the rotational actuation stage.
Figure 6:
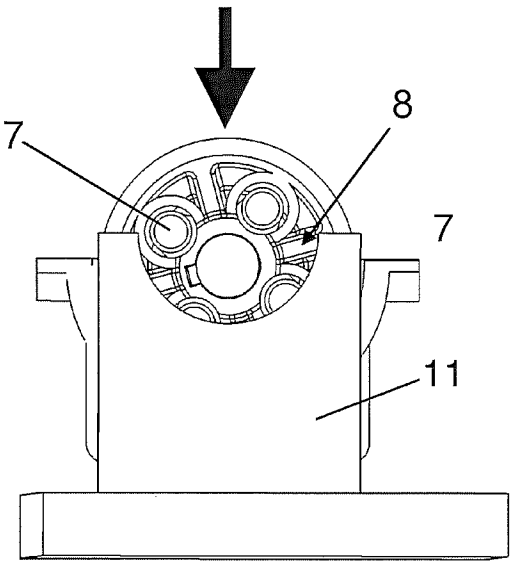
FIG. 6 illustrates an end view of the input unit in the pressure actuation stage.

A first end face of detent curve body 10 has an integrally molded detent curve 4. Detent curve 4 forms a plurality of alternate bumps and depressions. A second end face of detent curve body 10 opposite to the first end face of the detent curve body has one or more molded projections 7. As shown in FIGS. 2, 4, and 6, projections 7 (four are shown here as an example) are pencil shaped and symmetrically arranged parallel to shaft 9.

A compression spring 6 is within cavity 14 of the body of input member 1. Spring 6 is arranged to act on detent curve body 10 to bias detent curve body 10 in the axial direction away from the second end face of the detent curve body and toward the first end face of the detent curve body. As such, detent curve 4 is loaded by spring 6 in the axial direction away from the second end face of detent curve body 10.

A portion of carrier 2 adjacent the first end face of detent curve body 10 has a detent projection 5. Detent projection 5 abuts detent curve 4 of the first end of detent curve body 10. Spring 6 is carried on input member 1 to bias detent curve 4 towards detent projection 5. Thus, detent curve 4 engages with detent projection 5. Detent curve 4 presses against detent projection 5 as the detent curve is biased by spring 6 in the axial direction away from the second end face of detent curve body 10 and toward the detent projection.

A wall section 11 of housing part 3 adjacent the second end face of detent curve body 10 includes a recess 8. Projections 7 of the second end face of detent curve body 10 can axially insert into recess 8 of housing part 3. One or more of projections 7 axially insert into recess 8 when detent curve body 10 is axially displaced in a direction towards the second end face of the detent curve body during rotational actuation of input member 1.

FIGS. 1 and 2 illustrate sectional and end views, respectively, of the input unit during a neutral actuation stage. In the neutral actuation stage, input member 1 is not subjected to any pressure or rotational actuation. The position of detent curve body 10 relative to the body of input member 1 along the axial direction during the neutral actuation stage is seen in FIG. 1. As shown in FIG. 1, projections 7 on the second end face of detent curve body 10 are axially inward from wall section 11 of housing part 3. As shown in FIG. 2, projections 7 lie above recess 8 in wall section 11 of housing part 3 along the displacement axis normal to the rotation axis.

In the neutral actuation stage, input member 1 can be rotationally actuated to rotate about the rotation axis as projections 7 are not pressed against wall section 11 of housing part 3. The pressing of projections 7 against wall section 11 of housing part 3 would prevent displacement of detent curve body 10 along the axial direction. The pressing of projections 7 against wall section 11 would cause the engagement between detent curve 4 and detent projection 5 to be fixed in place as the detent curve is unable to rotate relative to the detent projection. As a result, rotation of input member 1 is prevented when projections 7 are pressed against wall section 11 of housing part 3.

Alternatively, in the neutral actuation stage, input member 1 can be pressure actuated to move along the displacement axis normal to the rotation axis as projections 7 are not axially inserted into recess 8 of wall section 11 of housing part 3. The insertion of any of projections 7 into recess 8 in wall section 11 of housing part 3 would prevent displacement of input member 1 along the displacement axis normal to the rotation axis (i.e., would prevent displacement of the input member in the direction normal to the axial direction). The insertion of projections 7 into recess 8 would cause the inserted projections to engage and be caught up on the end portion of wall section 11 forming recess 8. As a result, the inserted projections 7 would be unable to be displaced in the displacement axis normal to the rotation axis along the end portion of wall section 11 forming recess 8. As a result, pressure actuation of input member 1 is prevented when projections 7 are axially inserted into recess 8 of wall section 11 of housing part 3.

FIGS. 3 and 4 illustrate sectional and end views, respectively, of the input unit during a rotational actuation stage. During a rotational actuation of input member 1 (shown symbolically by the bent double arrow in FIG. 4) detent curve body 10 rotates with the body of input member 1 about the rotation axis. Rotation of detent curve body 10 causes detent curve 4 to be guided along detent projection 5, which is fixed to carrier 2. Since detent projection 5 lies on the bumps and depressions of detent curve 4, detent curve body 10 moves back and forth in the axial direction along shaft 9 (depicted in FIG. 3).

Even in the neutral position (shown in FIGS. 1 and 2) in which detent projection 5 penetrates into the depressions of detent curve 4, the distances between the ends of projections parts 7 and wall section 11 of housing part 3 are relatively small. In particular, the distances are smaller than the height of the bumps of detent curve 4. Thus, if during a rotational actuation (shown in FIGS. 3 and 4) one of the ridges of detent curve 4 lies on detent projection 5, then detent curve body 10 is displaced far enough in the axial direction against spring 6 that its projections 7 axially penetrate into recess 8 of wall section 11 of housing part 3. Since this occurs periodically in rapid succession during a rotational motion of input member 1, projections 7 penetrating into recess 8 thereby block a perpendicular pivoting action or sliding motion of carrier 2 relative to housing part 3. That is, pressure actuation of input member 1 which would cause the input member to be displaced along the displacement axis normal to the rotation axis is blocked due to the axial penetration of projections 7 into recess 8. The pressure actuation of input member 1 is blocked because the penetration of projections 7 into recess 8 prevents the input member from displacing along the displacement axis normal to the rotation axis. Thus, a rotational actuation of input member 1 blocks a simultaneous pressure actuation of the input member.

In the absence of a rotational actuation of input member 1, detent projection 5 extends into a depression of detent curve 4, whereby projections 7 as shown in FIGS. 1 and 5 do not block a sliding motion or pivoting action of carrier 2 relative to housing part 3 by a pressure actuation before wall section 11 ends.

FIGS. 5 and 6 illustrate sectional and end views, respectively, of the input unit during a pressure actuation stage. If a pressure actuation occurs by a force exerted on input member 1, then carrier 2 with the input member move along the displacement axis normal to the rotation axis in the direction of housing part 3. As FIGS. 5 and 6 illustrate, there are then at least one or more projections 7 lying below recess 8 of wall section 11 of housing part 3. Since the distance between projections 7 and the massive part of wall section 11 is less than the height of the bumps on detent curve 4, it is no longer possible to move the bumps on detent curve 4 past detent projection 5 by rotating input member 1. This is because projections 7 already impinge on wall section 11 and stop the displacement of detent curve body 10 against input member 1. Thus, a pressure actuation of input member 1 blocks a simultaneous rotational motion of the input member.

Such operating elements can advantageously be used in motor vehicles, particularly as coupling elements in steering wheel operating switches, middle consoles, and dashboards.

REFERENCE SYMBOLS

1 input member
2 carrier
3 housing part
4 detent curve
5 detent projection
6 (compression) spring
7 molded projections
8 recess
9 shaft
10 detent curve body
11 housing part wall section
12 facia panel
13 outer surface (section)
14 hollow cavity While exemplary embodiments are described above, it is not intended that these embodiments describe all possible forms of the present invention. Rather, the words used in the specification are words of description rather than limitation, and it is understood that various changes may be made without departing from the spirit and scope of the present invention. Additionally, the features of various implementing embodiments may be combined to form further embodiments of the present invention.

What is claimed is:

1. An input unit for an operating element that can be actuated by pressure or rotation, the input unit comprising:

a housing wall having a recess portion;

a carrier having a detent projection, the carrier being displacable relative to the housing wall along a displacement axis;

an input member mounted on a shaft rotatably mounted on the carrier to be rotatable about a rotation axis normal to the displacement axis;

the input member having a body with a cavity therein and a detent curve body movably arranged in the cavity such that the detent curve body is displaceable along an axial direction parallel with the rotation axis relative to the body of the input member, a first end of the detent curve body having a detent curve engaging the detent projection of the carrier, and a second end of the detent curve body being adjacent to the housing part and having projections;

the input member further having a spring that acts on the detent curve body to press the detent curve against the detent projection; and wherein the detent curve includes alternate detent elements and a height of the detent elements of the detent curve along the axial direction is greater than a distance between the projections and the recess portion of the housing wall along the axial direction while the input member is in an unactuated state.

2. The input unit of claim 1 wherein:

at least one of the projections inserts into the recess portion of the housing wall when the detent curve body is displaced in the axial direction towards the recess portion of the housing wall during rotational motion of the input member.

3. The input unit of claim 1 wherein:

at least one of the projections engages the housing wall when the input member is displaced along the displacement axis during pressure actuation of the input member.

4. The input unit of claim 1 wherein:

the input unit is built into a steering wheel or a dashboard of a motor vehicle.

5. An input unit comprising:

a housing wall having a recess portion;

a carrier having a detent projection, the carrier being displacable relative to the housing wall;

an input member mounted on a rotatable shaft on the carrier, the input member rotating when the input member is rotationally actuated, the input member displacing with the carrier relative to the housing wall when the input member is pressure actuated;

the input member having a body with a cavity therein and a detent curve body movably arranged in the cavity such that the detent curve body is displaceable relative to the body of the input member, a first end of the detent curve body having a detent curve engaging the detent projection of the carrier, and a second end of the detent curve body being adjacent to the housing wall and having projections;

the input member further having a spring that acts on the detent curve body to press the detent curve against the detent projection;

wherein at least one of the projections engages the housing wall when the input member, during pressure actuation of the input member, is displaced with the carrier relative to the housing wall which thereby prevents displacement of the detent curve body relative to the body of the input member thereby blocking concurrent rotational actuation of the input member;

wherein at least one of the projections inserts into the recess portion of the housing wall when the detent curve body, during rotational actuation of the input member, is displaced towards the recess portion of the housing wall to thereby block concurrent pressure actuation of the input member.

6. An input unit comprising:

a housing wall having a recess portion;

a carrier having a detent projection, the carrier being displacable relative to the housing wall along a displacement axis;

an input member mounted on a rotatable shaft on the carrier such that the input member, the input member rotating about a rotation axis normal to the displacement axis when the input member is rotationally actuated, the input member displacing with the carrier relative to the housing wall along the displacement axis when the input member is pressure actuated;

the input member having a body with a cavity therein and a detent curve body movably arranged in the cavity such that the detent curve body is displaceable along the rotation axis relative to the body of the input member, a first end of the detent curve body having a detent curve engaging the detent projection of the carrier, and a second end of the detent curve body being adjacent to the housing wall and having projections;

the input member further having a spring that acts on the detent curve body to press the detent curve against the detent projection;

wherein at least one of the projections engages the housing wall when the input member, during pressure actuation of the input member, is displaced along the displacement axis which thereby prevents displacement of the detent curve body along the rotation axis relative to the body of the input member thereby blocking concurrent rotational actuation of the input member;

wherein at least one of the projections inserts into the recess portion of the housing wall when the detent curve body, during rotational actuation of the input member, is displaced along the rotation axis relative to the body of the input member towards the recess portion of the housing wall to thereby block concurrent pressure actuation of the input member.

7. The input unit of claim 5 wherein:

the detent curve includes alternate detent elements; and a height of the detent elements of the detent curve along the axial direction is greater than a distance between the projections and the recess portion of the housing wall along the axial direction while the input member is in an unactuated state.

8. The input unit of claim 5 wherein:

the input unit is built into a steering wheel or a dashboard of a motor vehicle.

9. The input unit of claim 6 wherein:

the detent curve includes alternate detent elements; and a height of the detent elements of the detent curve along the axial direction is greater than a distance between the projections and the recess portion of the housing wall along the axial direction while the input member is in an unactuated state.

10. The input unit of claim 6 wherein:

the input unit is built into a steering wheel or a dashboard of a motor vehicle.

* * * * *